US006406514B1

(12) United States Patent
Vystrcil et al.

(10) Patent No.: US 6,406,514 B1
(45) Date of Patent: Jun. 18, 2002

(54) VACUUM CLEANER BASE ASSEMBLY

(75) Inventors: Robert A. Vystrcil, Garrettsville; Steven J. Paliobeis, Painesville, both of OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/758,728

(22) Filed: Jan. 11, 2001

(51) Int. Cl.[7] ..... A47L 9/22
(52) U.S. Cl. ..... 75/389; 15/412
(58) Field of Search ..... 15/389, 391, 392, 15/412

(56) References Cited

U.S. PATENT DOCUMENTS 2,740,984 A * 4/1956 Holt ..... 15/314
2,997,730 A * 8/1961 Dierks ..... 15/368
3,448,485 A * 6/1969 Worwag ..... 15/332
3,871,051 A * 3/1975 Collier ..... 15/321
4,351,078 A * 9/1982 Sternberg ..... 15/383
4,375,117 A * 3/1983 Lyman ..... 15/377
5,093,956 A 3/1992 Saunders et al.
5,309,601 A 5/1994 Hampton et al.
5,911,261 A 6/1999 Farone et al.
6,067,689 A 5/2000 Roney et al.

* cited by examiner

*Primary Examiner*—Chris K. Moore
(74) *Attorney, Agent, or Firm*—Fay, Sharpe, Fagan, Minnich & McKee, LLP

(57) ABSTRACT

A vacuum cleaner base assembly includes a housing and a motor having a driveshaft. The motor is mounted in the housing and a brush is rotatably mounted in the housing in a spaced manner from the motor. An endless belt is looped over the driveshaft and the brush, and extends therebetween. A motor holding bracket is mounted to the housing. The motor holding bracket has a finger which resiliently urges the motor away from the brush, increasing a distance between the driveshaft and the brush, thereby tensioning the belt.

23 Claims, 6 Drawing Sheets

VACUUM CLEANER BASE ASSEMBLY

BACKGROUND OF THE INVENTION

1. Field of the Invention

The present invention relates to vacuum cleaners. More particularly, the present invention relates to a new base assembly for a vacuum cleaner. Even more particularly, the invention relates to a motor holding bracket of such a base assembly.

2. Description of Related Art

Typically, vacuum cleaners include an upper portion having a handle, by which an operator of the vacuum cleaner may grasp and maneuver the cleaner, and a lower cleaning nozzle or base portion which travels across a floor, carpet, or other surface being cleaned. The upper portion often houses or supports a dirt and dust collecting filter bag or a dust cup. The cleaning nozzle is hingedly connected to the upper portion. It is well known that the upper portion is usually pivotable in relation to the base between a generally vertical upright storage position and an inclined operative position. The underside of the base includes a suction opening formed therein which is in fluid communication with the filter bag.

A vacuum or suction source such as a motor and fan assembly is enclosed either within the nozzle portion or the upper portion of the cleaner. The vacuum source generates the suction required to pull dirt from the carpet or floor being vacuumed through the suction opening and into the filter bag. A rotating brush assembly is typically provided in proximity to the suction opening to loosen dirt and debris from the carpet being vacuumed.

Because the motor and fan assembly is the source of the suction, it is critical to the operation of a vacuum cleaner. Of particular importance is the drive system comprising the motor and the brush. Common in the art is a motor with a drive shaft and a cog pulley which drives the rotatable brush via a belt. Improper functioning of the belt-type drive system is often caused by inadequate tension in the belt, which reduces the ability of the brush to rotate and hence loosen the dirt and debris to be acquired by the suction, impairing the overall cleaning ability of the vacuum cleaner. In addition, inadequate tension in the belt may lead to the generation of excessive noise, creating an unpleasant effect for the operator and other persons nearby. A significant factor affecting the tension of the belt is the placement and mounting of the motor. This is especially true for dedicated brush drive motors in a two motor vacuum cleaner which has a separate suction motor.

Static motor mounting systems for vacuum cleaners are known in the art. For example, U.S. Pat. No. 5,309,601 issued to Hampton et al. teaches the use of a mounting block and mounting clip to secure a motor to the nozzle portion of a vacuum cleaner. U.S. Pat. No. 5,093,956 issued to Saunders et al. discloses the use of a two-part plastic housing which includes a static motor mount. U.S. Pat. No. 6,067,689 issued to Roney et al. illustrates a belt shifter mechanism but still teaches static mounting of the motor unit.

The disadvantage of these static systems is the inability of the motor to keep a proper tension on the belt over time. As a vacuum cleaner is used repeatedly, the belt may begin to stretch or wear, or various components, such as the brush or motor, may become unseated in a respective housing. When these conditions occur, a statically mounted motor is not able to compensate, thus allowing an inadequate tension to occur on the belt, resulting in the problems described above.

To overcome these problems, a solution lies in the mounting system for the motor unit. The other mounted component which may be an initial consideration as a solution is the rotatable brush. However, creating a resilient mount for the brush is an impractical task. The brush is rotatably mounted at opposing ends and each end must be properly aligned with the other for the belt to drive the brush. A resilient mount on just one end of the brush would allow misalignment, as would a resilient mount on both ends because of a likely non-uniform response. As a result, a resilient mounting system is most readily suited for the motor unit.

Accordingly, it is desirable to develop a new base assembly for a vacuum cleaner which would overcome the foregoing difficulties and others by allowing a more responsive mounting of a vacuum cleaner motor.

SUMMARY OF THE INVENTION

According to the present invention, a new and improved vacuum cleaner base assembly is provided.

In accordance with a first aspect of the present invention, a vacuum cleaner base assembly is provided. The assembly includes a housing and a motor having a driveshaft. The motor is mounted in said housing and a brush is rotatably mounted in said housing in a spaced manner from said motor. An endless belt is looped over the driveshaft and the brush, and extends therebetween. A motor holding bracket is mounted to said housing. The motor holding bracket comprises a finger which resiliently urges the motor away from the brush, increasing a distance between the driveshaft and the brush, thereby tensioning the belt.

In accordance with another aspect of the present invention a vacuum cleaner base assembly is provided. The assembly comprises a housing including a distal end and a proximal end and a brush rotatably mounted to the housing near the proximal end thereof. A motor, including a driveshaft extending therefrom, is affixed to the housing between the brush and the housing distal end and an endless belt is looped over the driveshaft and the brush, and extends therebetween. A motor holding bracket, comprising a resilient portion which urges the motor towards the distal end of the housing, increases a distance between the drive shaft and the brush, thereby creating tension in the endless belt.

In accordance with yet another aspect of the present invention, a vacuum cleaner base is provided. The base includes a housing for the vacuum cleaner, said housing comprising an indentation and a motor having a first portion held in said indentation. A bracket is mounted to said housing and encircles a second portion of the motor, wherein said bracket comprises a resilient portion which urges said motor in one direction in relation to said housing.

BRIEF DESCRIPTION OF THE DRAWINGS

The invention may take form in certain components and structures a preferred embodiment of which will be illustrated in the accompanying drawings wherein.

DETAILED DESCRIPTION OF THE PREFERRED EMBODIMENTS

Figure 1:
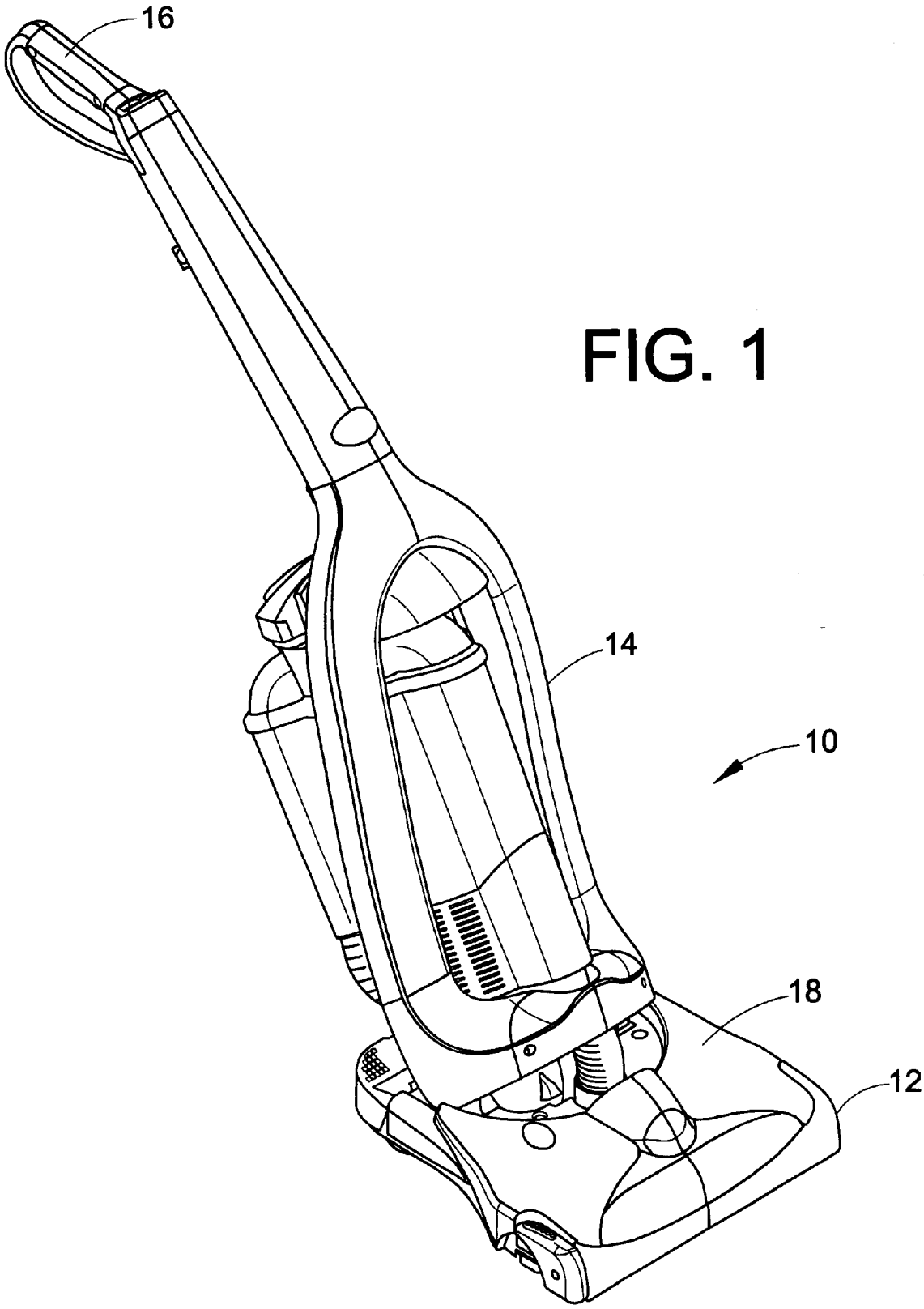
FIG. 1 is a perspective view of an upright vacuum cleaner employing a base assembly in accordance with the present invention.

Referring now to the drawings, wherein the showings are for purposes of illustrating a preferred embodiment of the invention only and not for purposes of limiting the same, FIG. 1 shows an upright vacuum cleaner 10 in accordance with the present invention. The vacuum cleaner 10 comprises a base unit assembly 12, sometimes referred to as a nozzle base, and an upper portion 14, which typically houses or supports a dirt and dust filter bag or a dirt cup, which terminates in a handle 16. The base unit 12 includes a cover 18.

Figure 2:
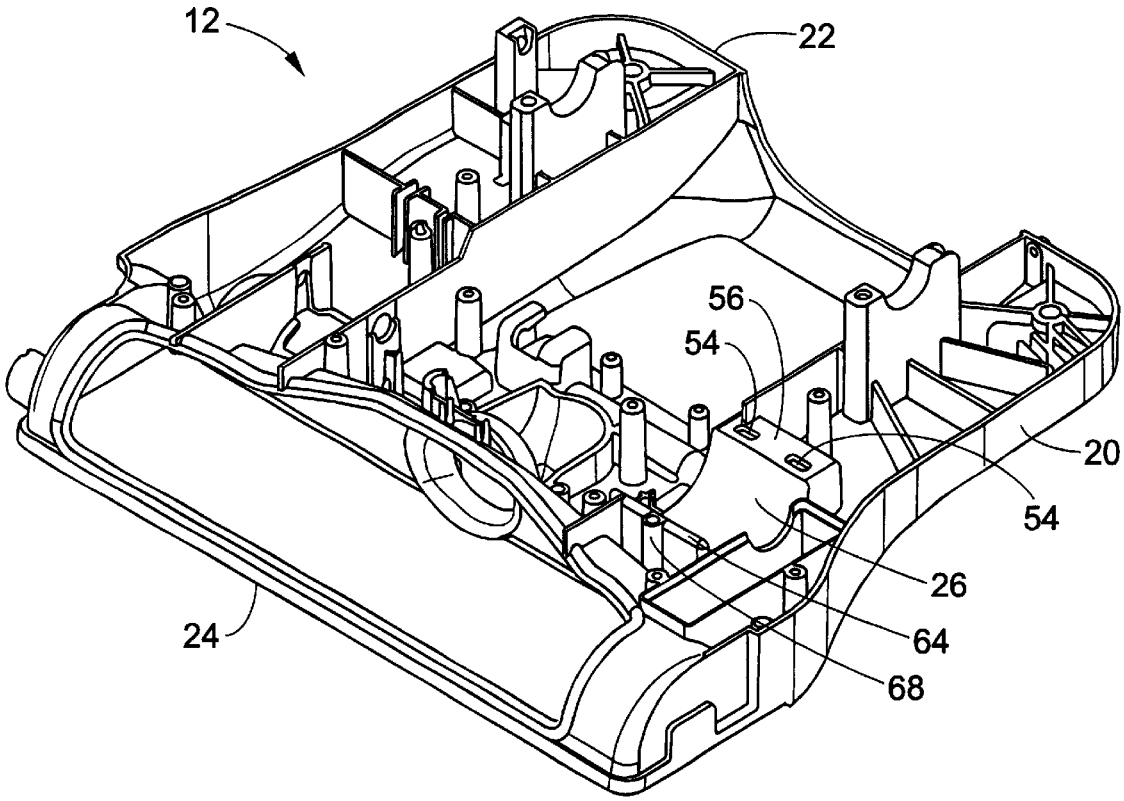
FIG. 2 is a top perspective view of a lower portion of the base assembly of FIG. 1.

With reference now to FIG.2, a top perspective view of a lower portion of the base unit 12 is shown with the cover 18 (referring back to FIG. 1) removed. The base assembly 12 includes a lower housing 20 which has a distal end 22 and a proximal end 24. An indentation 26 is defined in the housing 20 for receiving a motor unit.

Figure 3:
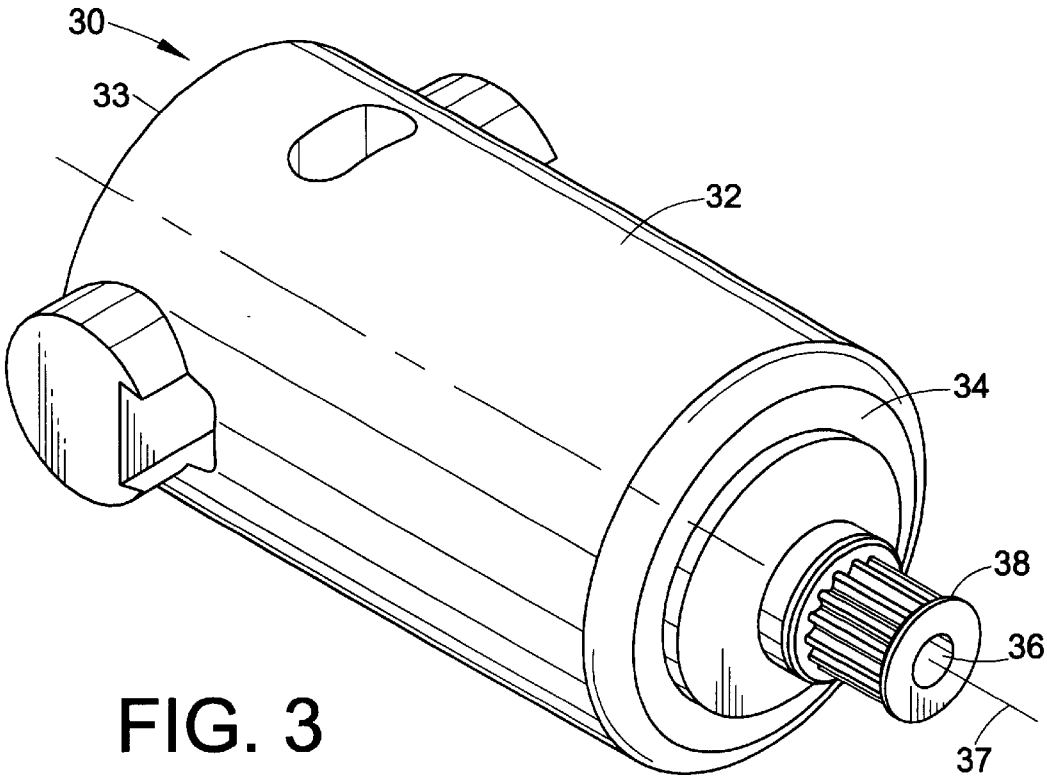
FIG. 3 is an enlarged perspective view of a motor unit used in the vacuum cleaner of FIG. 1.

FIG. 3 shows a perspective view of a motor unit 30 that can be used in the base assembly according to the present invention. The motor unit 30 is a conventional electric motor, which has an outer periphery defined by a casing 32. The motor has a first end 33 and a second end 34 and a driveshaft 36 which extends outward from the body second end and along a longitudinal axis 37 of the motor 30. A cog pulley 38 is affixed to the driveshaft 36 as known in the art.

Figure 4:
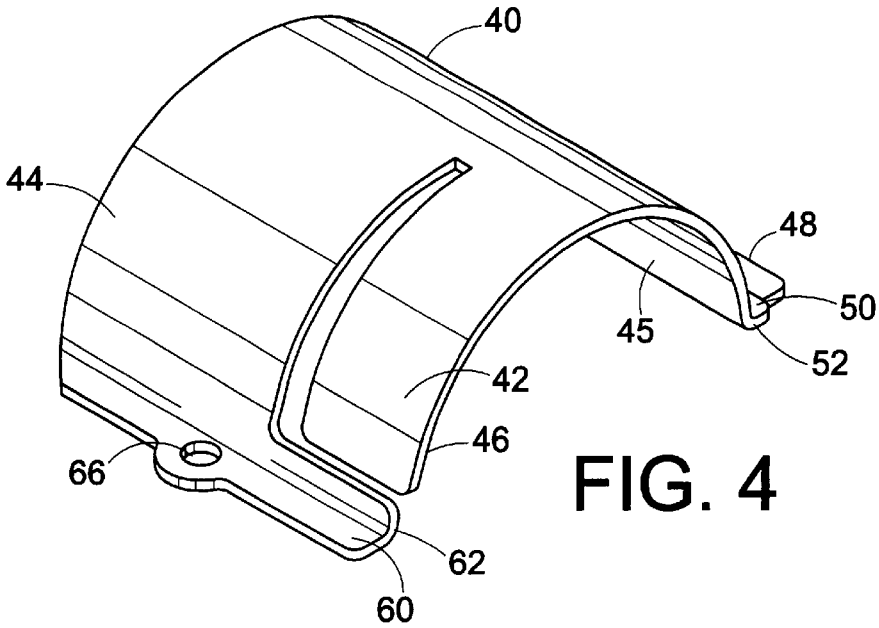
FIG. 4 is an enlarged perspective view of a motor holding bracket used in the base assembly of FIG. 1.

Turning now to FIG. 4, a motor holding bracket 40 is used to secure the motor 30 (referring back to FIG. 3) to the housing 20 (referring back to FIG. 2). A finger portion 42 of the bracket is a resilient member which allows a resilient mounting of the motor 30 on the base lower housing 20. The bracket 40 also includes a more rigid base body portion 44 to which the finger 42 is secured for structural stability. Being appropriately semicircular in shape, the motor holding bracket 40 approximates the shape and size of the motor 30. More particularly, an inner surface 45 of the bracket body 44 is slightly larger in diameter than the outer casing 32 of the motor 30 and encircles at least a portion of the outer casing 32. An inner surface 46 of the finger portion 42 has a diameter smaller than that of the body 44 which results in the finger portion 42 resiliently contacting the motor 30 and biasing same.

The motor holding bracket is mounted to the housing 20 through at least one tab 48 which extends from a tangential flange 50 located along a first edge 52 of bracket body 44. Preferably two such tabs are provided, located in a spaced manner from each other. Each tab is seated in a respective aperture 54 (FIG. 2) in the housing 20. More particularly, the apertures are located in a plateau 56 located behind the indentation 26 as shown in FIG. 2. Also shown in FIG. 4 is a flange 60 extending tangentially from a second edge 62 of bracket body 44. The flange 60 is adapted to overlie a portion 64 of the housing 20 located forwardly of the indentation 26 (referring back to FIG. 2). At least one orifice 66 is located in the flange 60 to accept a suitable fastener 67 (FIG. 7) to mount the bracket 40 to the housing 20. Suitable fasteners for this purpose can include conventional screws, rivets, pins, positively engaging twist lock members, and so forth. It is apparent from FIG. 2 that the fastener will engage in a boss 68 of the housing. A combination of at least one tab 48 and a flange 50 may be used as shown. Alternatively, flanges alone can be used on both the first and second edges 52 and 62 of the bracket body 44. In addition, the tabs 46 may be used on both the first and second edges 52 and 62. In such an embodiment, corresponding apertures replace the boss in the housing, so that a bracket, made of a resilient material, may be compressed, the tabs inserted into apertures, and the bracket released, thereby securing the motor unit to the housing.

Figure 5:
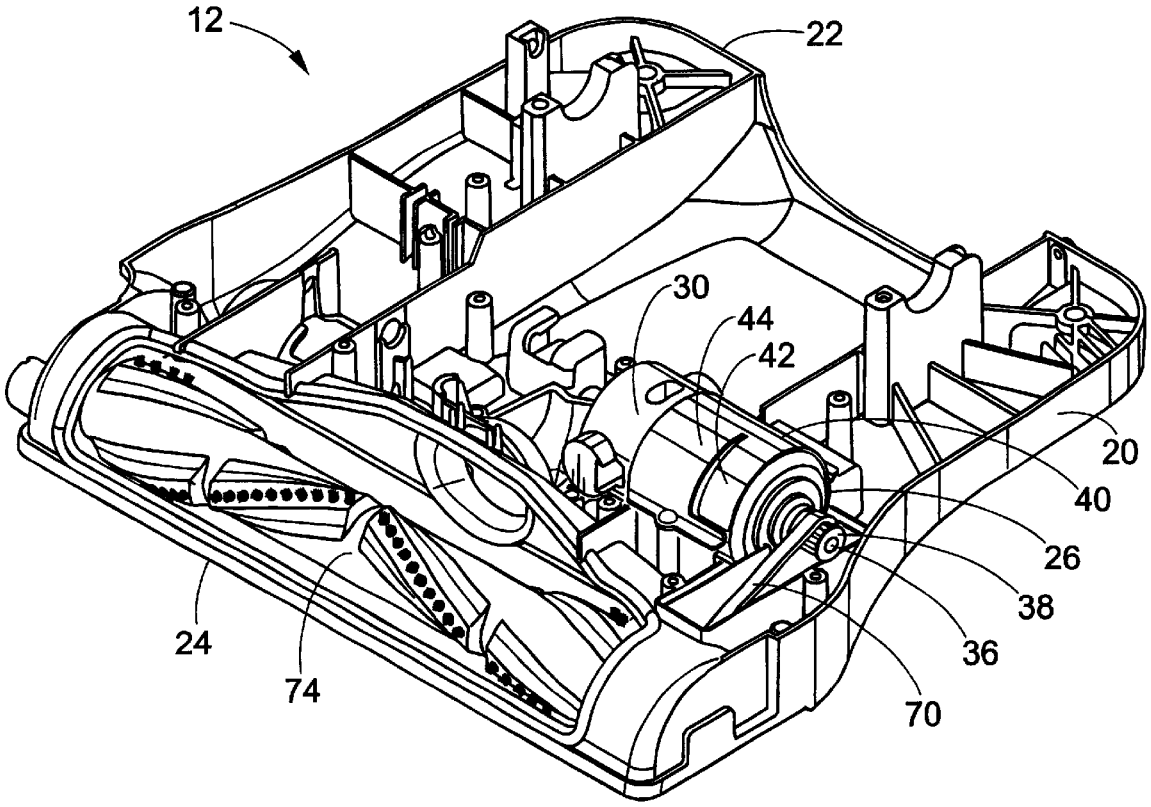
FIG. 5 is an assembled perspective view of the lower portion of the base assembly of FIG. 1 showing the placement of the motor of FIG. 3 and the bracket of FIG. 4 as well as a belt and a brushroll.

Referring now to FIG. 5, the housing 20 of the base assembly 12 showing the mounting of the motor 30 using the holding bracket 40 is illustrated. The motor 30 is held in the indentation 26, which has an inner diameter slightly larger than the circumference of the motor 30 to allow the motor 30 to shift slightly. The indentation 26 and the bracket 40 cooperate to surround the motor 30. An endless belt 70 is looped over the driveshaft 34 and grips the driveshaft 34 via the pulley 38. The endless belt 70 is also looped over a portion of the brush 74 and extends between the driveshaft 34 and the brush. The belt provides the rotational force to move the brush 74 as is known in that art.

The motor holding bracket 40 is affixed to the housing 20 as previously described. The bracket body 44 is surroundingly disposed about a portion of the motor 30 while the finger portion 42, with its smaller diameter, makes contact with the motor 30 urging it away from the brush 74, thereby increasing the distance between the driveshaft 34 and the brush 74. More particularly, the brush 74 is rotatably mounted typically near the proximal end 24 of the housing 20 in a spaced manner from the motor 30. The motor 30 is mounted to the lower housing 20 between the brush 74 and the distal end 22. The finger portion 42 of the motor holding bracket 40 urges the motor 30 towards the distal end 22 of the housing 20.

With continuing reference to FIG. 5, the increase in distance between the driveshaft 34 and the brush 74 increases the tension of the belt 70, as the belt is looped over each and extends therebetween. The motor holding bracket 40 is of a resilient material such as spring steel, other metal or a polymer or composite material exhibiting elastic properties. Because of the resiliency of the material of the bracket 40, the motor 30 is urged gently and responsively so that a uniform level of tension is maintained, rather than being urged in a completely inelastic manner which may create a sudden undesirable change in tension or decreased responsiveness.

In addition, the inner diameter of the finger portion 42 is calculated to provide a desired level of tension in the endless belt 70. For example, the smaller the inner diameter of the finger 42, the greater the urging of the motor 30 away from the brush 74, thus creating a greater distance between the driveshaft 34 and the brush 74 and a higher tension in the belt 70. In this manner, should less tension in the belt 70 be desired, the inner diameter of the finger portion 42 may be increased, in turn decreasing the urging of the motor 30 away from the brush 74. Such changes in geometry may be coupled accordingly with material selection based upon the materials described above. The combination of a calculated geometry and specific materials allows the attainment of an even more specific desired tension level in the belt 70.

By creating a base assembly 12 in which a resilient bracket 40 operates to responsively mount the motor 30, as the belt 70 wears, the motor 30 is shifted in a direction away from the brushroll 74 to maintain proper tension in the belt 70. This response may ensure proper performance of the brush 74 and reduce the generation of excessive noise caused by a slack belt. Proper tension also reduces undue wear on the components of the drive system, often providing for increased component life. In addition, it is easier for a user or repair person to change or reattach the belt by pushing against the finger 42 thereby loosening the belt 70, providing for easy removal and reinstallation thereof.

Figure 6:
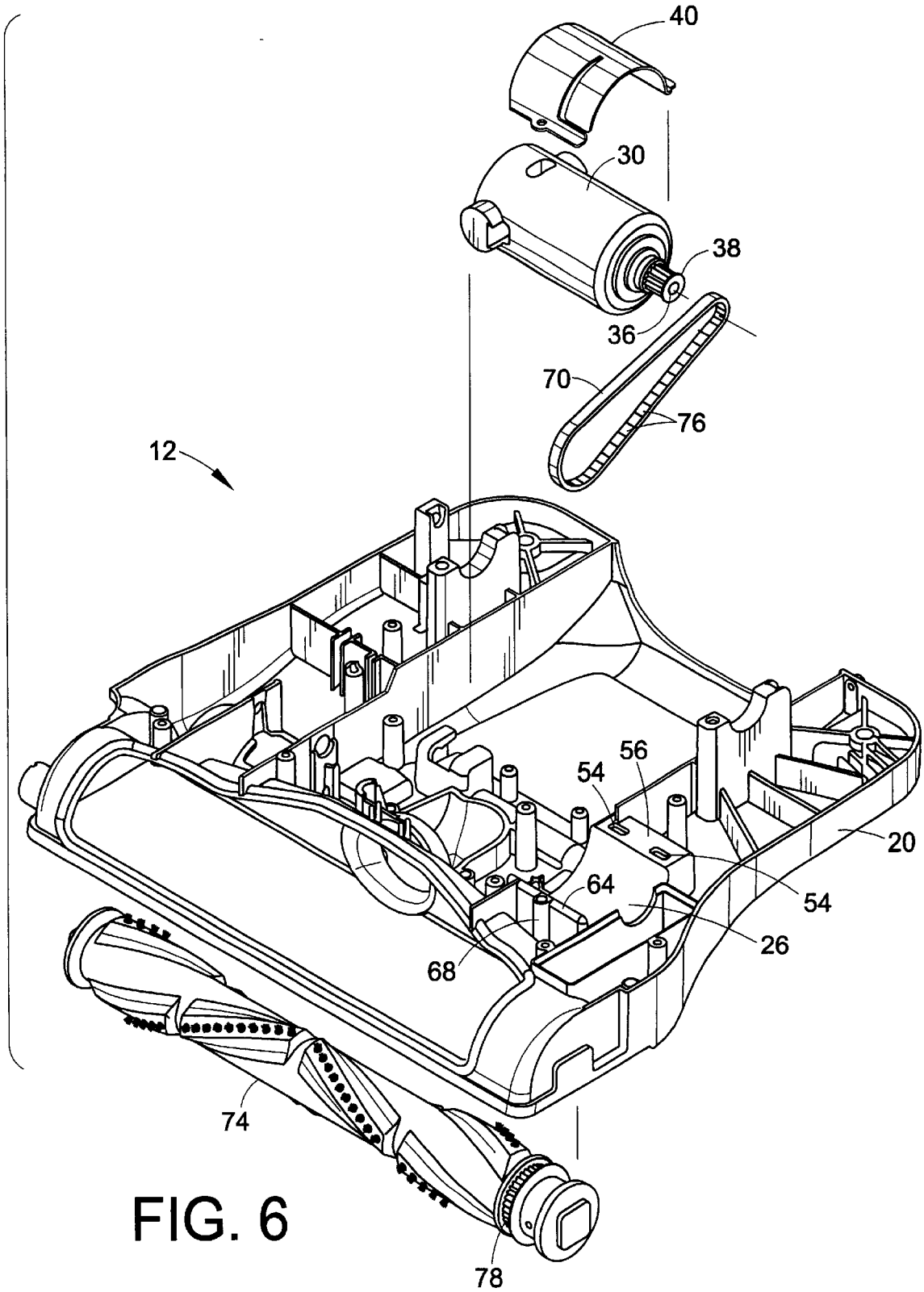
FIG. 6 is an exploded perspective view of the lower portion of the base assembly of FIG. 1 showing the motor of FIG. 3 and the bracket of FIG. 4 as well as a belt and a brushroll.

Turning now to FIG. 6, some of the components of the base assembly 12 are illustrated in an exploded manner. The motor 30 is received in the indentation 26 which is located in between the plateau 56 and the portion 64 containing the boss 68 in the housing 20. The motor holding bracket 40 is surroundingly disposed about a portion of the motor 30 to flexibly retain it in the indentation 26. As described above, the bracket 40 is secured to the housing 20 at the plateau 56 via the apertures 54 and at the portion 64 via fastening means 67 (FIG. 7) which connect to the boss 68. The endless belt 70 includes teeth 76 which correspond to the cogs of the cog pulley 38 which is mounted on the driveshaft 36. The teeth 76 allow the belt 70 to be driven by the motor 30 with reduced slippage, thereby promoting increased efficiency. The teeth 76 in the belt 70 also correspond to a cogged portion 78 of the brush 74 which is rotatably mounted in the housing 20. The cooperation of the belt teeth 76 and the brush cog 78 reduces slippage of the belt 70 on the brush 74, continuing to increase the driving efficiency of the system. The resilient finger portion 42 of the bracket 40 optimizes the tension in the belt 70 as described above, again increasing the efficiency gained through the interaction of the belt teeth 76 with the cog pulley 38 and the brush cogs 78.

Figure 7:
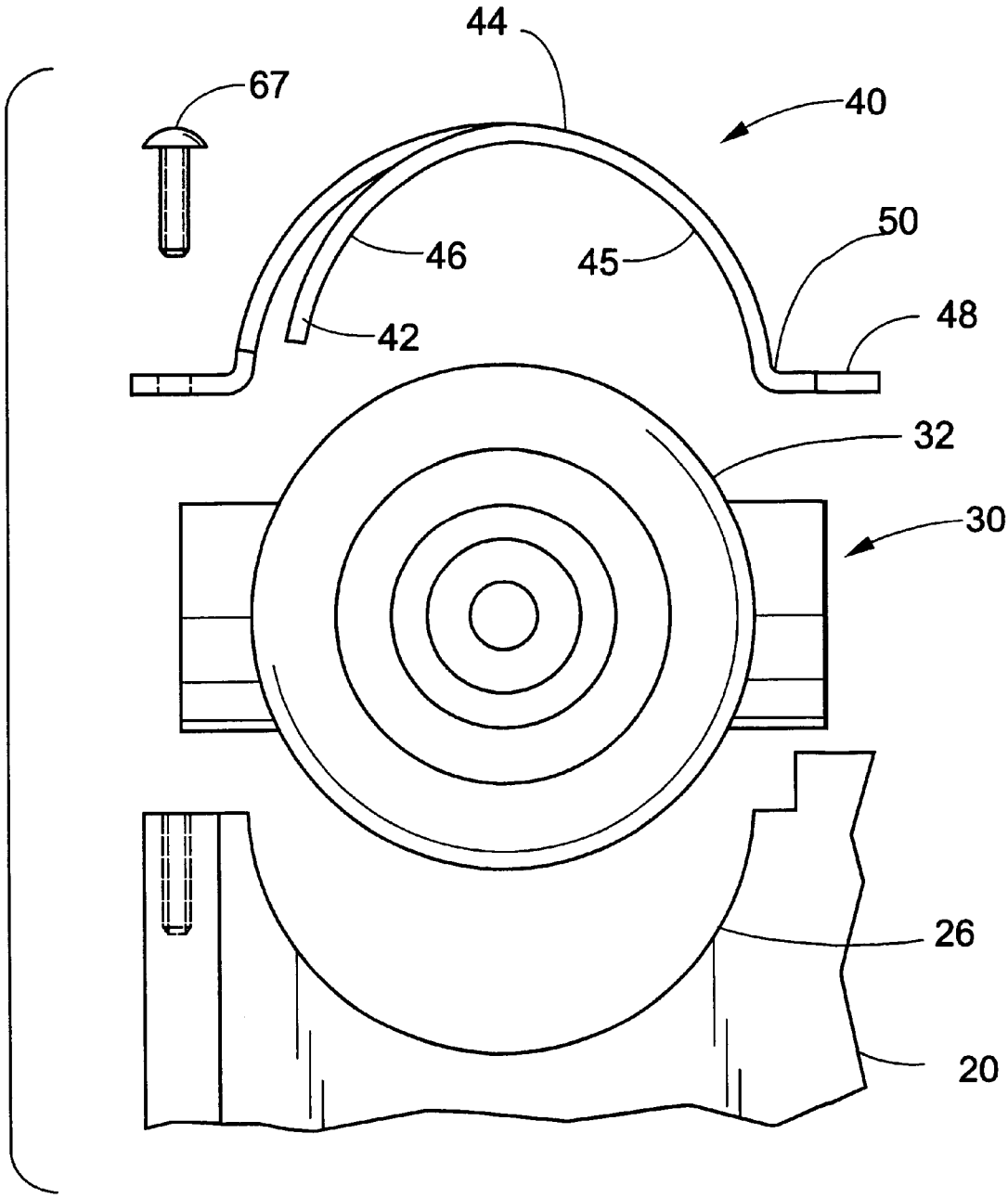
FIG. 7 is an exploded end view of the motor of FIG. 3 and the bracket of FIG. 4 and an adjacent portion of the base assembly of FIG. 1.

With reference to FIG. 7, an exploded end view of the motor unit 30 and the bracket 40 illustrates in more detail the relationship of these components. The inner surface 45 of the bracket body 44 is slightly larger than the diameter of the motor casing 32, while the inner surface 46 of the finger portion 42 is positioned to contact the casing 32. The finger portion 42 contacts the motor unit casing 32 to urge the motor 30 in a desired direction. The motor 30 reaches a positive limit provided by the bracket body 40 and the indentation 26 of the housing 20, preventing over-tensioning of the belt 70 (FIG. 6). The bracket 40 is secured to the housing 20 by the tabs 48 and the fastening means 67 as described above, thus securing the finger portion 42 against the motor unit casing 32, providing a stable, yet resilient, mount for the motor 30.

The invention has been described with reference to a preferred embodiment. Obviously, modifications and alterations will occur to others upon reading and understanding the preceding detailed description. It is intended that the invention be construed as including all such modifications and alterations insofar as they come within the scope of the appended claims or the equivalents thereof For example, the figures and description have depicted the present invention as it relates to an embodiment in the nozzle or base portion of an upright vacuum cleaner. It is anticipated that the present invention could also be applied to a motor assembly in the upper portion of the cleaner. It is also anticipated that the present invention will be applied to other styles of brush type vacuum cleaners, such as compact vacuum cleaners and portable vacuum cleaners. Furthermore, the present invention could be used in single motor systems which use the same motor for both the fan and the brushroll.

Having thus described the invention, we claim:

1. A vacuum cleaner base assembly, comprising:

a housing;

a motor having a driveshaft, mounted in said housing;

a brush rotatably mounted in said housing in a spaced manner from said motor;

an endless belt looped over the driveshaft and the brush, and extending therebetween; and a motor holding bracket mounted to said housing, said motor holding bracket comprising a finger which resiliently urges the motor away from the brush, increasing a distance between the driveshaft and the brush, thereby tensioning the belt.

2. The vacuum cleaner base assembly of claim 1, wherein the motor holding bracket surrounds a portion of a circumference of the motor.

3. The vacuum cleaner base assembly of claim 1, wherein the motor holding bracket further comprises a base portion to which said finger is secured, wherein said base portion has an inner surface that encircles at least a portion of an outer surface of the motor.

4. The vacuum cleaner base assembly of claim 3, wherein said bracket finger has a smaller diameter than said bracket base portion to provide a desired level of tension in the endless belt.

5. The vacuum cleaner base assembly of claim 1, wherein the motor holding bracket comprises a resilient material.

6. The vacuum cleaner base assembly of claim 1, wherein the motor holding bracket further comprises at least one tab for mounting the bracket to the housing.

7. The vacuum cleaner base assembly of claim 1, wherein the motor holding bracket further comprises at least one flange for mounting the bracket to the housing.

8. A vacuum cleaner base assembly, comprising:

a housing including a distal end and a proximal end;

a brush rotatably mounted to the housing near the proximal end thereof;

a motor including a driveshaft extending therefrom, the motor affixed to the housing between the brush and the housing distal end;

an endless belt looped over the driveshaft and the brush, and extending therebetween; and a motor holding bracket, comprising a resilient portion which urges the motor towards the distal end of the housing, increasing a distance between the drive shaft and the brush, thereby creating tension in the endless belt.

9. The vacuum cleaner base assembly of claim 8, wherein the motor holding bracket is surroundingly disposed about at least a portion of the motor.

10. The vacuum cleaner base assembly of claim 8, wherein the motor holding bracket further comprises a base portion to which said resilient portion is secured, wherein said base portion has an inner surface which encircles at least a portion of an outer surface of the motor.

11. The vacuum cleaner base assembly of claim 10, wherein said bracket is semicircular in shape and wherein said bracket resilient portion has a smaller diameter than said bracket base portion to provide a desired level of tension in the endless belt.

12. The vacuum cleaner base assembly of claim 8, wherein the motor holding bracket comprises a resilient material.

13. The vacuum cleaner base assembly of claim 8, wherein the motor holding bracket further comprises at least one tab for mounting the bracket to the housing.

14. The vacuum cleaner base assembly of claim 8, wherein the motor holding bracket further comprises at least one flange for mounting the bracket to the housing.

15. A vacuum cleaner base, comprising:

a housing for the vacuum cleaner, said housing comprising an indentation;

a motor having a first portion held in said indentation; and a bracket mounted to said housing and encircling a second portion of the motor, wherein said bracket comprises a resilient portion which urges said motor in one direction in relation to said housing.

16. The vacuum cleaner base of claim 15, wherein the housing indentation and the bracket cooperate to surround the motor.

17. The vacuum cleaner base of claim 15, wherein the bracket further comprises a base portion to which said resilient portion is secured.

18. The vacuum cleaner base of claim 17, wherein said bracket is semicircular in shape and wherein said bracket resilient portion has a smaller diameter than said bracket base portion to urge said motor in said one direction.

19. The vacuum cleaner base of claim 15, wherein the bracket comprises a resilient material.

20. The vacuum cleaner base of claim 15, wherein the bracket further comprises at least one tab for insertion into an aperture in the housing, the tab located along a first edge of the bracket.

21. The vacuum cleaner base of claim 20, wherein the bracket further comprises a flange adapted for overlying a portion of the housing, the flange being located along a second edge of the bracket.

22. The vacuum cleaner base of claim 21, wherein the second edge of the bracket defines at least one orifice.

23. The vacuum cleaner base of claim 22, further comprising a fastener extending through said orifice to secure the bracket to the housing.

* * * * *